United States Patent [19]

Gansert et al.

[11] Patent Number: 4,531,796

[45] Date of Patent: Jul. 30, 1985

[54] ELECTRICAL PLUG-AND-SOCKET CONNECTOR

[75] Inventors: Willi Gansert, Kornwestheim; Dieter Hussmann, Steinheim; Gert Jakob, Stuttgart, all of Fed. Rep. of Germany

[73] Assignee: Robert Bosch GmbH, Stuttgart, Fed. Rep. of Germany

[21] Appl. No.: 493,257

[22] Filed: May 10, 1983

[30] Foreign Application Priority Data

May 18, 1982 [DE] Fed. Rep. of Germany ..... 3218677

[51] Int. Cl.[3] ..... H01R 11/00

[52] U.S. Cl. ..... 339/60 M; 339/61 M; 339/94 M; 339/186 M

[58] Field of Search ..... 339/60 R, 60 C, 60 M, 339/61 R, 61 M, 94 R, 94 C, 94 M, 184, 186

[56] References Cited

U.S. PATENT DOCUMENTS

| | | | |
|---|---|---|---|
| 2,036,002 | 3/1936 | Walter | 339/90 C |
| 2,400,351 | 5/1946 | Hart | 339/90 C |
| 3,519,975 | 7/1970 | Prow, Jr. et al. | 339/94 M |
| 3,588,783 | 6/1971 | Newman | 339/59 M |
| 3,787,796 | 1/1974 | Barr | 339/60 R |
| 4,084,875 | 4/1978 | Yamamoto | 339/94 M |
| 4,164,636 | 8/1979 | Gallagher | 339/60 R |
| 4,193,655 | 3/1980 | Herrmann, Jr. | 339/94 M |
| 4,214,802 | 7/1980 | Otari et al. | 339/60 M |
| 4,343,526 | 8/1982 | Hobson et al. | 339/90 R |

FOREIGN PATENT DOCUMENTS

| | | |
|---|---|---|
| 1009695 | 10/1953 | Fed. Rep. of Germany . |
| 1045507 | 3/1955 | Fed. Rep. of Germany . |

OTHER PUBLICATIONS

O. Richter and R. V. Voss—"Bauelemente Der Feinmechanik" (Fifth Edition 1952), pg. 277.

*Primary Examiner*—Gil Weidenfeld
*Assistant Examiner*—Paula A. Austin
*Attorney, Agent, or Firm*—Frishauf, Holtz, Goodman & Woodward

[57] ABSTRACT

An electrical connector combination thoroughly sealed against moisture and dirt and resistant to temperature variations and shaking forces consists of a male connector (1) equipped with connector prongs (3) set in a casing (2) and a female connector (10) having corresponding sockets (12) disposed in a casing (13) in which a compressible seal plug (22) is set which surrounds the conductors which are electrically and mechanically affixed to the connector sockets (12). The seal plug 12 is compressed by an assembly of rigid parts including the casing plug (13), a metallic washer (25) and a cap nut (27), the last of which can be screwed tight with a certain torque to clamp the assembly. A sealing effect is exerted on the conductors (11) and the casing plug (13) in a radial direction without exposing the seal plug (22) to rotary movement. A seal ring (9) is seated on a forward section (15) of the socket casing plug (13) extending into the male connector casing (2). This seal ring seals the joint of the connector parts with the help of a connection sleeve acting through a bayonnet lock, without the seal ring being able to yield radially.

9 Claims, 11 Drawing Figures

Fig. 3
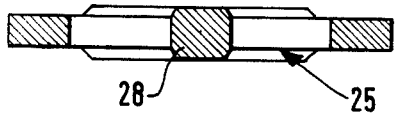
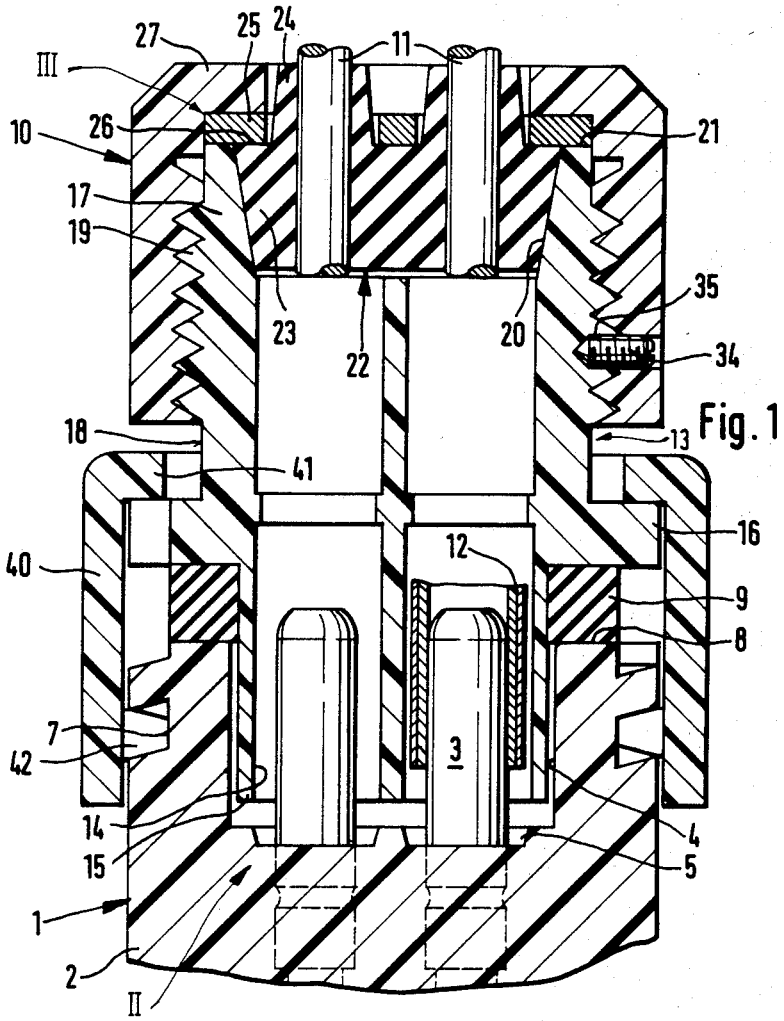
Fig. 1
Fig. 2
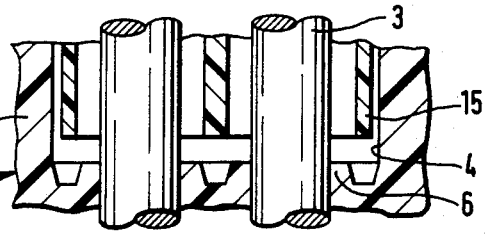

ELECTRICAL PLUG-AND-SOCKET CONNECTOR

This invention concerns an electrical connector of the plug and socket type providing protection to the wires being connected and to their attachment to the connector elements against the effects of moisture, vibration, etc.

Electrical plug-and-socket connectors have long been known having a first component provided with connection prongs and a second connector piece having sockets fastened to the ends of electrical conductors disposed so as to be relieved of tension strains, with seals for the entrances of the conductors into the connector components provided by sealing material surrounding the conductors and held by a compression nut. In such connectors, the connector components are sealed off from each other in the connector condition and can be clamped with a nut.

Known connectors having the characteristics above described are neither sufficiently tight with respect to moisture and dirt, nor as resistant to temperature, shaking and vibration effects to be really suitable for use in motor assemblies for utility.

The Invention

It is an object of the invention to provide a plug-and-socket connector suitable for connections to motor assemblies of trucks and other utility vehicles with a higher degree of resistance to temperature changes and shaking forces and a capability of excluding moisture and dirt.

Briefly, the seals include an elastic pressure plug surrounding the electrical conductors. This part is disposed in a narrowing cavity of a socket-connector holding body and is held in the cavity by means of a cap nut and a pressure ring exerting a desired tightening force against the connector body and the electrical conductors. The nut is secured in its position on the socket-connector holding body by means of a safety device. The socket-connector holding body has a forward sleeve extending inside the sleeve portion of the casing of the mating plug connector body. A seal ring lies against that forward sleeve of the socket connector holding body for its full height and the face of the seal ring turned away from the socket-connector holding body is pressed against the face of the casing of the mating body when the connector assembly is securely connected.

The electrical plug-and-socket connection of the invention has the advantage that it meets the strict requirements for the rough conditions of operation in motor vehicles, particularly because of the tightness properties with respect to penetration by moisture and dirt to the conductors and their surrounding sealing means upon insertion into the other connector part, as well as in the locations where the two connector parts abut each other. Furthermore, a safety arrangement is advantageously provided by which the correct tightening of the cap nut is compelled in assembly on the cable. The position of the tightened-on nut is maintained and unintended changes of the position of the cap nut are made impossible. A further advantage is to be seen in the adequately temperature-resistant construction which has the further advantage of being sturdy for rough handling, satisfies requirements for long life and, in addition, is economical for mass-production and is of a spacesaving construction.

The arrangement of socket connector casing, pressure ring and cap nut forming a stiff block is particularly advantageous for damping oscillatory movements of the conductors which can be excited by the motor and by the travel movements of the motor vehicle. Thus, damaging relative movements of the sockets with respect to the plugs are prevented, and no rotary movements are allowed to affect the sealing pressed part. Furthermore, no elastic member is present in the block connection, a feature that avoids loosening by changes of shape and a relaxation of the set pressure force applied to the compressed seal plug.

There is also the further advantage that the female connector component is provided with a configuration engageable by an outer sleeve which secures the connector parts together in the plugged-in condition. Its casing is flush in the axial direction with a seal ring sealing the joint between the connector components. In consequence, only direct pressure appears as a closure force and no undesired bending forces appear.

In order to prevent the securing sleeve from sticking onto the connector body carrying it when the connection between the connector parts is released, so that the connector body tries to turn with the connection sleeve even though the socket elements are not pulled off the connector prongs yet, a reverse turning preventer is provided in an advantageous way by features which are integral with the connection sleeve or the cap nut. Finally, by the use of insulating synthetic resin material for the connector casings and the parts accommodating the plugs and for the nuts, a compact and short construction results which is economical to manufacture in large quantities for an electrical connector of low weight.

BRIEF DESCRIPTION OF THE DRAWINGS

The invention is further described by way of illustrative embodiment with annexed to the annexed drawings, in which:

FIG. 1 is a longitudinal section through an electrical plug-and-socket connector;

FIG. 2 is a partial section through a modification of the first connector part at II in FIG. 1;

FIG. 3 is a longitudinal section through a modified pressure ring at III in FIG. 1;

DESCRIPTION OF THE ILLUSTRATED EMBODIMENTS

Figure 4:
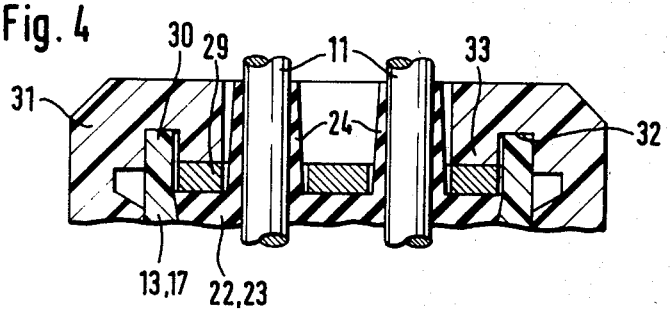
FIG. 4 is a partial section through a modification of the second connector part.

FIG. 1 shows, in section, a connector according to the invention with the two separable parts engaged together. The illustrated connector is designed for connection to the motor portion of a truck or other utility vehicle and has a first connector part 1 which is the male component of the connector combination, having a connector casing 2 of insulating synthetic plastic of cup-shape from the bottom of which there internally project a number (in this case two) of round connector prongs 3, the bases of which are sealed in place by being embedded in the casing 2. The casing 2 has a shell section 4 spaced from and surrounding the prongs 3 as a group, and the bottom of the cavity thus formed has a further depression 5 encircling each of the prongs 3. Instead of the depressions 5 around the prongs 3, it is also possible, as shown in FIG. 2, to provide a raised ring 6 around each prong 3 at the bottom of the cavity.

On the outside of the shell portion 4 of the casing 2 are obliquely running grooves 7 for providing a bayonnet-lock for an external retaining ring 40. The face 8 of the casing 2 has a flat annular surface for apposition of a seal ring 9.

A second connector part 10, the female component of the combination, is disposed on the end of a cable composed of insulated electrical conductors 11 at the respective ends of which socket elements 12 have been affixed by a suitable forcefit or soldered connection. This second connector part 10 has a connector socket casing plug 13 of insulating synthetic plastic having longitudinal bores 14 in each of which one of the connector sockets 12 affixed to a conductor 11 is seated and locked in place in a known way not further described or shown here.

The socket casing plug 13 has a section 15 of an outside diameter suitable for fitting it in the shell or receptable section 4 of the casing 2 of the male connector, and this section 15 of the socket casing plug 13 has cavities, the walls of which surround, but are spaced from, the ends of the connector sockets 12. The previously mentioned seal ring 9 is disposed on the outside of the forward section 15 and, in the longitudinal direction, lies against the bead 16 of the casing plug 13, which bead has about the same outer diameter as the connector casing 2. On the other side of the bead 16 of the socket casing plug 13, there extends a holding section 17 having a greater diameter than the forward section 15. The holding section 17 has a length 18 of reduced external diameter between the bead 16 and the external threading 19 which is integral with the holder section 17 of the casing plug 13. Instead of the external threading 19, the grooves of another bayonnet-lock could be provided in a modified form of construction.

The longitudinal bores 14 all have their mouths in a common internal cavity of an end section 20 shown at the top of the holder section 17 of the plug 13 in FIG. 1, terminating in the end face 21 of the casing plug 13. That cavity narrows conically from its widest part at the end face 21 down to the bottom where the longitudinal bores 14 connect to it. A rubber compression plug 22 is set into the conical cavity of the end section 20. The plug 22 is drawn over the conductors 11 and surrounds them in with its likewise conical seal section 23 set into the conical cavity of the rigid plug section 20 and also has sleeve-like extensions 24 projecting above the seal portion 23 of the plug 22. The conical seal section 23 of the pressure plug 22 is somewhat greater than the conical cavity of the end section 20 of the rigid socket casing plug 13 in order to obtain a stronger radial sealing effect against the individual conductors 11, as well as against the end section 20 of the casing plug 13. In the assembly of the second connector part 10, a metal pressure ring 25 surrounding the projecting sleeves 24 and the conductors 11 is pressed in by means of a pressure nut 27 against the face 26 of the conical sealing section 23 of the pressure plug 22 and the end face 21 of the socket casing plug 13. The pressure nut 27 is screwed onto the external threads 19. The metal pressure washer 25 thereby serves as a slip-allowing component for the nut 27 in the usual way. In consequence, there can be no rotary movement of the pressure plug 22 surrounding the conductors 11 in response to tightening of the nut 27. Furthermore, by the construction of a block out of the rigid parts provided by the casing plug 13, pressure washer 25, and pressure nut 27, tightening of the nut 27 with a certain considerable torque is possible in order to hold the pressure washer 25 sufficiently fast against the casing plug 13. In the pressure joint there is thus no elastic member contained which has any tendency towards permanent deformation which could produce undesired unstressing or loosening of the connection, which would lead to impairment of the sealing effect. Thus, as a result of the screw connection of rigid parts 13,21; 25; 27 the clamping pressure on the pressure plug 22 and therefore the sealing effect are maintained over the service life of the connector combination.

The sleeve-like extensions 24 surrounding the conductors 11, in addition to providing a prolongation of the seal region along the conductors 11, also provide protection against sharp bending of the cable composed of the conductors 11 without extending the length of the connector combination as a whole.

In the modification shown in FIG. 3, the pressure washer 25 is constituted with a reinforcement 28 in the central portion corresponding to the cap aperture of the pressure nut 27. Since in this region the washer 25 is not compressed, the thickening 28 of the washer 25 takes up the elastic reaction forces of the rubber plug 22. The modification of the pressure washer 25 likewise produces no undesired lengthening of the connector combination as a whole.

If it is not possible to provide a combination of a rigid pressure ring 25 between two rigid parts 13,21;27, for example by the use of a smaller pressure washer 29, the holding section 17 of the connector socket casing plug 13 can be provided, in accordance with a modification shown in FIG. 4, with a cylindrical end section 30 which prolongs the internally conical end section 20 and seats the pressure ring 29 which lies against only the end face 26 of the pressure plug 22. A modified cap-nut 31 is then provided in its cap portion 32 with an internal axially projecting annular ridge 33. When the pressure cap-nut is screwed onto the threads 19 of the socket casing plug 13, the ridge 33 lying against the pressure ring 29 is pressed against the face 26 of the resilient plug 22. The completely screwed on nut 31 has its cap portion 32 pressed against the end face 21 of the socket casing plug 13, while the ridge 33 projects within the cylindrical end section 30. In this embodiment too, no rotation of the pressure plug 22 is possible when the nut 31 is screwed on, because the pressure plug is again with its seal section 23 within the end section 20,30 of the socket casing plug 13.

A safety device is formed for the nut 27 or 31 that assures that in assembly of the second connector part 10 on the cable stem, the nut 27 or 31 is screwed on far enough. Furthermore, the position of the pressure nut 27 or 31 in its screwed-on condition is maintained by the safety device. Finally, an unintended change of the position of the nut 27 or 31 is prevented.

In a first embodiment of the safety device just mentioned for the screwed-on nut 27 or 31, a threaded pin 34 is screwed into a blind radial bore 35 which is bored through the nut and into the holding section 17 of the casing plug 13 in the screwed-in condition of the nut 27 or 31. The threaded pin 34 can have self-tapping threads. On the other hand, the bore 35 can be tapped to provide threads therein before the threaded pin 34 is screwed in.

In a first modification the threaded pin 34 penetrates into the external threading 19 of the casing plug 13 only with its tip after passing through the nut 27 or 31. In a second modification, several core-holes distributed around the circumference are formed in manufacture of the casing plug 13. The nut 27 or 31 is correspondingly provided in manufacture with elongated holes passing therethrough. The screwing-in of the threaded pin 34 with self-tapping threads takes place there a core hole of the casing plug 13 registers with an elongated hole of the pressure nut 27 or 31.

Figure 5:
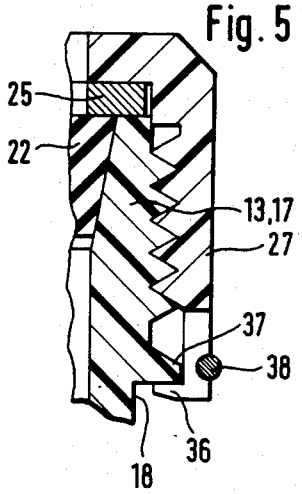
FIG. 5 is a partial section through a second embodiment of a safety device of the second connector part.

In a second embodiment of the safety device, illustrated in FIG. 5, spring hooks 36 are formed on the circumference of the rim of the threaded portion of the cap-nut 27 or 31. The holding section 17 of the casing plug 13 is provided, at the end of its external threading 19 which is towards the annular gap 18, with a peripheral bead 37. When the nut 27 or 31 is screwed onto the external threads 19, the hooks 36 slide over the external threads 19 and catch behind the bead 37 at the end of the threads 19 when the nut 27 or 31 is fully screwed on. Unscrewing of the nut 27 or 31 is possible only when at the same time the hooks 36 are raised. A split spring ring 38 is set in a groove in the back of the hooks 36 as a supplementary securing of the hooks 36 against spreading apart. The ring 38 holds the hooks 36 locked behind the bead 37, which further impedes any change of the position of the screwed on nut 27 or 31.

Figure 6:
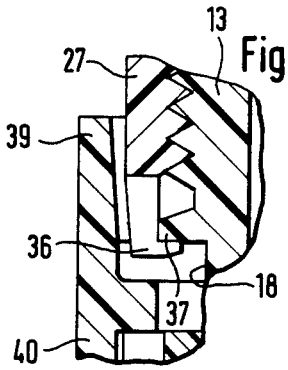
FIG. 6 is a modification of the security device of FIG. 5.

A modification of the safety system using the hooks 36 is shown in FIG. 6. The hooks 36 project, in the screwed-on condition of the nut 27 or 31, into a safety shield 39 surrounding them in sleeve fashion. The safety shield is made integral with a connection nut 40 which holds the two connector parts 1 and 10 together in engaged condition. The safety shield 39 can also be made integral with the socket casing plug 13. The safety shield 39 prevents spreading of the hooks 36 caught behind the bead 37, so that loosening of the nut 27 or 31 is possible only by destruction of the nut 27 or 31 or of the part 40 carrying the safety shield 39.

When the two connector parts 1 and 10 are in their connected condition, the seal 9 provided on the forward section 15 of the socket casing plug 13 lies with its respective faces on the flange 16 of the casing plug 13 and on the face 8 of the connector casing 2. The forward section 15 of the plug 13 projects into the shell section 4 of the connector casing 2 so that when the connector parts 1 and 10 are connected together, the seal ring 9 cannot be radially clamped in and damaged. The depressions 5 or the beads 6 which surround the round prongs 3 at the bottom of the cavity of the shell section 4 further lengthen the surface leakage path for any moisture that might penetrate into the neighborhood of the seal 9.

The connection nut 40 holding the connector parts 1 and 10 together is pushed over the outer threading 19 of the casing plug 13 and lies with its internal annular shoulder 41 loosely against the flange 16 of the casing plug 13. Near its other end there are three knobs on the inside of the connecting nut, offset from each other by 120° corresponding to the beginnings of the grooves 7 of the connector casing 2, lying lengthwise in a plane perpendicular to the longitudinal axis of the connecting nut 40. The grooves 7 of the casing 2 and the knobs 42 of the connecting nut 40 form a bayonnet lock by which the connector parts 1 and 10 of the electrical connector combination can quickly and securely be connected or released.

Figure 7:
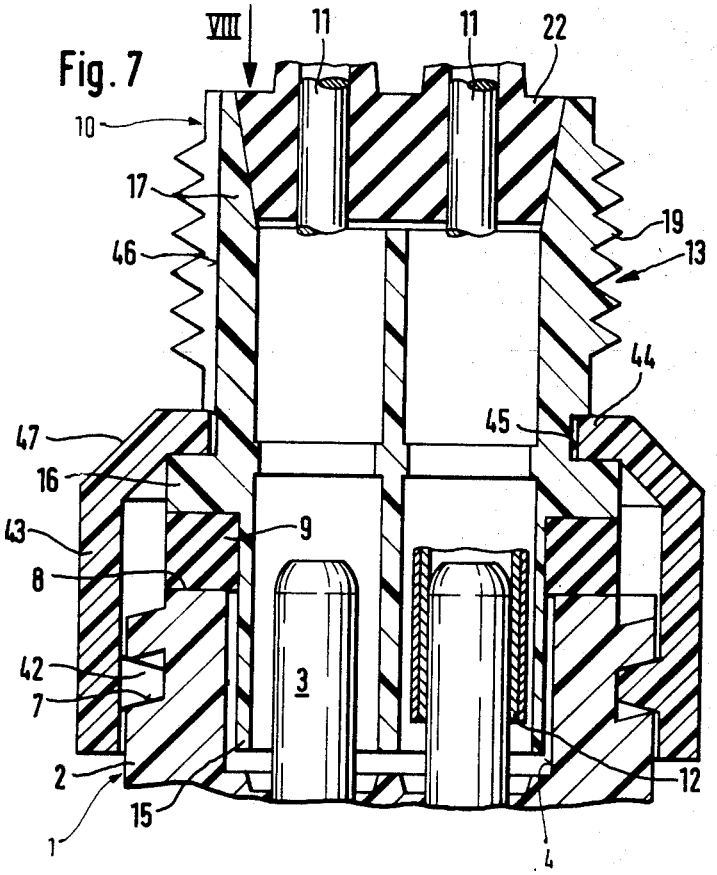
FIG. 7 is a partial section of a second illustrative embodiment of a connection arrangement of the two connector components.
Figure 8:
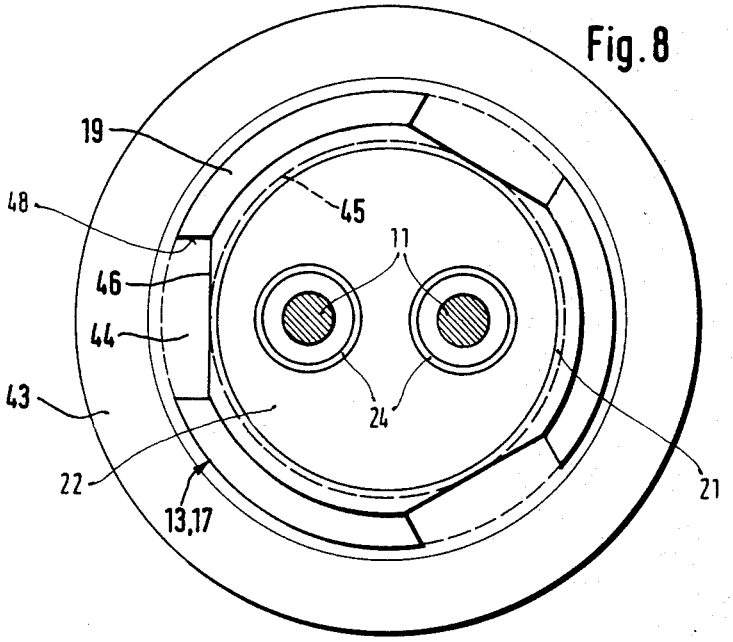
FIG. 8 is a plan view in the direction of the arrow VIII in FIG. 7.

A second embodiment of the connection of the two connector parts 1 and 10, by means of a connecting sleeve, is illustrated in FIGS. 7 and 8. The connecting sleeve 43, instead of being provided with an internal annular shoulder, has three internally projecting lips 44 offset by 120° from one to the next. The lips 44 grasp into a ring-shaped cavity 45 of the casing plug 13 which is made deeper than the gap 18 of FIG. 1 and press against the circular flange 16. The force transfer zone of the connection sleeve 43,44 at the flange 16 is now directly flush with the seal zone of the seal ring 9 which is pressed against the end face 8 of the connector casing 2. The socket casing plug 13 with its flange 16 is thus exposed only to pressure forces operating in the longitudinal direction. The flange 16 is no longer exposed to bending forces. Furthermore, there is spacesaving because the bearing surface at the flange 16 lies within the outer diameter of the casing plug 13.

The holding section 17 of the socket casing plug 13 is provided with three longitudinal grooves 14 for putting the connection sleeve 43 onto the casing plug 13. The longitudinal grooves 46 start from the ring-shaped cavity 45, are offset by 120° and correspond in their width to the width of the lips 44 of the connection sleeve 43.

In order to reduce the space requirement in the region where the connection sleeve 43, with its lips 44, is put onto the flange 16 of the casing plug 13, the lips 44 can have a beveled transition 47 joining them to the remainder of the connection sleeve 43.

Figure 9:
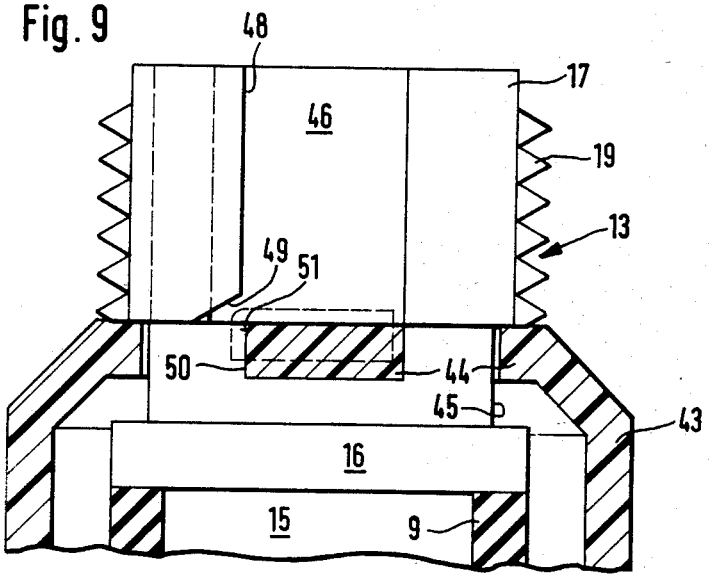
FIG. 9 is a reverse-turn preventer for the connection nut, partly in section.

When the connection between the connector parts 1 and 10 is released, the lips 44 of the connection sleeve 43 are prevented from getting into the grooves 46 of the casing plug 13 and turning the plug 13 with them, to the damage of the connector, by means of a reverse movement safeguard shown in FIG. 9. The perpendicular groove side 48 of each longitudinal groove 46 runs out into the annular cavity 45 in the direction of rotation for release of the connection sleeve 43 through an oblique transition 49 broadening only one side of the groove. The opposite side 50 of the corresponding lip 44 has a rounded-off edge 51. When the connection sleeve 43 is turned, the rounded-off edges 51 of the lips 44 slide on the bevels 49 of the groove edges 48. No supplementary parts are accordingly needed for the prevention of reverse twist when the molded in bevels 49 and rounded edges 51 are provided for permitting release as shown. The reverse twist prevention also requires no prolongation or broadening of the individual parts of the connector combination.

Figure 10:
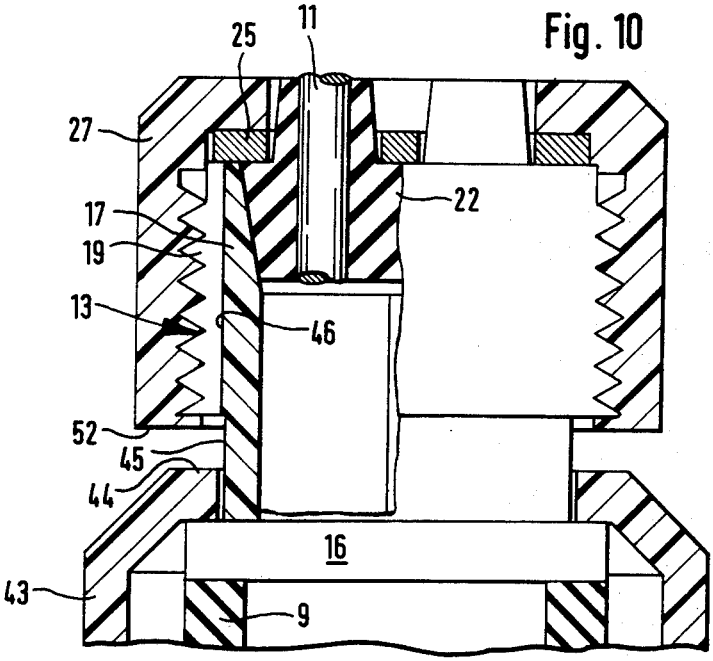
FIG. 10 is a modification of the reverse-turn protection system of FIG. 9, partly in longitudinal section.

FIG. 10 shows a modification of the reverse twist prevention in which the pressure nut 27 extends to a small extent over the longitudinal groove 14 into the annular cavity 45. The lips 44 then slide along the end face 52 of the pressure nut 27 when the connection sleeve 43 is released.

The connection sleeve 40;43, instead of being entirely of insulating plastic, can also be provided with a light metal shell or be manufactured entirely of light metal in order to make possible rough handling without damage in the operation of trucks or other similar heavy motor vehicles.

Figure 11:
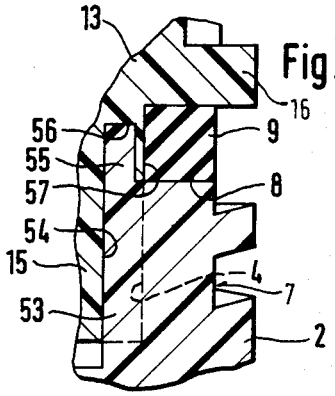
FIG. 11 is a coding device for the two connector components, in partial section.

FIG. 11 (on the same sheet as FIG. 1) illustrates an example of coding the configuration of the parts 1 and 10 of the connector so that they can be put together only in the proper configuration. The connector casing 2 has a strip 53 running in the longitudinal direction formed on it in the receptacle portion 4 of the casing. The socket casing plug 13 is provided with a corresponding longitudinal groove 54 in its forward section 15. The connector parts 1 and 2 can accordingly be fitted together only in the desired relative position.

In order to prevent, if need be, the occurrence of a false touching of contacts, the strip 53 is provided with a projection 55 protruding beyond the face 8 of the connector casing 2. The projection 55 and the corresponding undercut end cavity 56 of the groove 54 of the casing plug 13 are offset slightly radially so that the cylindrical seating surface 57 is preserved for providing a good sealing effect of the seal ring 9.

The electrical connector combination of the invention can also be used as a "flying" coupling. The first connector part 1 containing the prongs 3 then has a connector casing 2 out of which the conductors affixed to the prongs 3 in a known and not further illustrated manner are led over to the motor structure. The prongs 3 can be cast into the connector casing 2 in a pressure-tight and moisture-tight fashion. Likewise, the electrical conductors fastened to the prongs 3 which lead to the motor structure can be sealed in the connector casing 2 in the same way as the conductors 11 in the connector socket casing plug 13.

Thus, although the invention has been described and illustrated with reference to a particular embodiment and a number of modifications thereof, it will be understood that further variations and modifications are possible within the inventive concept.

We claim:

1. Weatherproof, dirtproof and shakeproof electrical connector assembly comprising a rigid cup-shaped first connector body (1) of insulating material having a cup-bottom portion in which prong connector elements (3) are set which have forward extremities and a hollow cylindrical portion (4) which has an exterior, has an annular extremity (8) and encircles a space into which said prong elements extend, and a second rigid connector body (10) having a front portion for facing said first connector body and a rear portion for leading out wires and having socket connector elements (12) affixed to ends of wires (11) inserted through said rear portion of said connector body, a socket-confining casing plug (13) having exterior and interior surfaces, a compressible seal plug (22) for said wires, through which said wires pass, a stiff pressure washer (25) and a capnut (27, 31) provided with an interior surface having screw threads, through which capnut said wires pass, said capnut being mounted for pressing said washer, seal plug, casing plug and second connector body into a rigid block and thereby sealing said wires pressure tight in said casing plug, said assembly further comprising:

a rim-like extension (17) of said casing plug (13) extending to an annular rear extremity thereof and having an external surface and a frustoconical internal surface (20) for seating said seal plug (22), said seal plug having a complementary frustoconical external surface therefor, said pressure washer (25) fitting against an annular shoulder (26) of said seal plug for forcing said seal plug into said rim-like extension (17) of said casing plug (13) and also being stoppable by the rear extremity of said rim-like extension of said casing plug (13), said capnut (27, 31) being tightenable on the exterior surface of said casing plug (13) by rotary motion for pressing said pressure washer (25) against said seal plug (22);

a flange (16) on said casing plug (13), having a front surface facing the extremity (8) of said cylindrical portion (4) of said first connector body (1) and having a rear surface, and a forward extension (15) of said casing plug, extending forward beyond said flange and beyond the forward extremities of said socket elements (12), fitting loosely within said cylindrical portion (4) of said first connector body (1), having cavities (14) which laterally surround said respective socket elements (12) at an annular gap spacing therefrom and having an external surface;

a seal ring 9 having its full axial dimension interposed between said casing plug flange (16) and the extremity (8) of said cylindrical portion (4) of said first connector body (1) for compression therebetween, said seal ring (9) fitting also about the external surface of said casing plug forward extension (15) for limiting inward expansion of said seal ring, and sleeve-like securing means (40, 43) tightenable on the exterior of said cylindrical portion (4) of said first connector body (1) by rotary motion and having inturned grasping means (41, 44) reaching around said flange (16) of said casing plug (13) for securing together said first (1) and second (10) connector bodies while compressing said seal ring (9).

2. Connector assembly according to claim 1, in which said means for securing said capnut in tightened position on said casing plug comprise an aperture in said capnut (27), a cavity in said casing plug (13) and a securing pin (34) fitting into said aperture and cavity.

3. Connector assembly according to claim 1, in which said first connector body, said casing plug of said second connector body, said capnut of said second connector body and said sleeve-like securing means are all made of insulating synthetic plastic.

4. Connector assembly according to claim 1, in which said seal plug (22) has a sleeve-like rearward extensions (24) respectively surrounding each of the wires passing through said seal plug over a length of said wires extending rearwardly of said pressure washer (25) said extensions (24) of said seal plug (22) passing through apertures in said pressure washer (25) and serving for preventing buckling of said wires.

5. Connector assembly according to claim 1, in which said means for securing said capnut (27) in tightened position on said casing plug comprise features (36;37) integrally formed on said casing plug and said capnut for securing said capnut (27) in a predetermined position on said casing plug (13).

6. Connector assembly according to claim 5, in which said means for securing said capnut (27) in tightened position on said casing plug comprise resilient catch means (36) and in which means (38;39) surrounding said catch means (36) are provided for preventing disturbance of said catch means.

7. Connector assembly according to claim 1, in which said sleeve-like securing means (40, 43) and the said exterior of said cylindrical portion of said first connector body (1) are of a configuration for providing a bayonnet lock, and in which said inturned grasping means of said sleeve-like securing means comprise lip strips (44) for bearing against said rear surface of said flange (16) of said casing plug (13).

8. Connector assembly according to claim 7, in which longitudinal grooves (46) are provided on the periphery of said casing plug (13) for guiding said sleeve-like securing means over said casing plug, said longitudinal grooves (46) being fitted to said lip strips (44) in number, spacing and width and extending from said flange (16) substantially to the rear extremity of said casing plug.

9. Connector assembly according to claim 8, in which threading is provided on the exterior surface of said casing plug and for tightening said cap on said casing plug, in which also said longitudinal grooves interrupt said threading on said casing plug, said grooves being further provided with features (51;49) for preventing rotation of said capnut relative to said casing plug in the releasing direction.

* * * * *